US008078092B2

(12) United States Patent
Barton et al.

(10) Patent No.: US 8,078,092 B2
(45) Date of Patent: Dec. 13, 2011

(54) APPARATUS AND METHOD FOR CONTROLLING THE AXIAL RATE OF MOVEMENT OF A FUSING BELT IN A PRINTING APPARATUS

(75) Inventors: Augusto E. Barton, Webster, NY (US); Faming Li, Penfield, NY (US); Daniel J. McVeigh, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 12/693,049

(22) Filed: Jan. 25, 2010

(65) Prior Publication Data

US 2011/0182635 A1 Jul. 28, 2011

(51) Int. Cl.
*G03G 15/20* (2006.01)

(52) U.S. Cl. ..... 399/329; 399/67; 399/328

(58) Field of Classification Search ..... 399/67, 399/328, 329
See application file for complete search history.

(56) References Cited

U.S. PATENT DOCUMENTS

| | | | | |
|---|---|---|---|---|
| 5,027,160 | A * | 6/1991 | Okada et al. | 399/329 |
| 5,365,321 | A * | 11/1994 | Koshimizu et al. | 399/329 |
| 5,964,339 | A * | 10/1999 | Matsuura et al. | 198/810.03 |
| 6,181,900 | B1 * | 1/2001 | Lee et al. | 399/165 |
| 6,198,902 | B1 * | 3/2001 | Vaughan et al. | 399/329 |
| 6,246,858 | B1 * | 6/2001 | Condello et al. | 399/329 |
| 6,263,181 | B1 * | 7/2001 | Vaughan et al. | 399/325 |
| 6,405,854 | B1 * | 6/2002 | Cumberlege | 198/806 |
| 6,431,348 | B2 * | 8/2002 | Malmberg | 198/806 |
| 7,416,074 | B2 * | 8/2008 | Otomo et al. | 399/163 |
| 2003/0053833 | A1 * | 3/2003 | Kinoshita et al. | 399/384 |
| 2007/0172272 | A1 * | 7/2007 | Miyata et al. | 399/329 |
| 2008/0317526 | A1 * | 12/2008 | Fujimori et al. | 399/329 |
| 2009/0003866 | A1 * | 1/2009 | Uchida et al. | 399/68 |
| 2009/0169274 | A1 * | 7/2009 | Suzuki et al. | 399/302 |
| 2010/0080598 | A1 * | 4/2010 | Nakazato | 399/66 |

* cited by examiner

*Primary Examiner* — Ryan Walsh
(74) *Attorney, Agent, or Firm* — Ronald E. Prass, Jr.; Prass LLP

(57) ABSTRACT

An apparatus (100) and method (400, 500) that controls the rate of movement of a fusing belt in a printing apparatus is disclosed. The apparatus can include a fusing belt (120) and at least one fusing belt support roller (131), where the fusing belt can be entrained on the fusing belt support roller. The fusing belt support roller can have an axis of rotation (135). The apparatus can include a pressure roller (132) that contacts the fusing belt to form a fusing nip (137). The pressure roller and the fusing belt can be configured to fuse an image on a media sheet (112) in the fusing nip. The apparatus can include a belt position changing mechanism (150) coupled to the fusing belt. The belt position changing mechanism can be configured to move the fusing belt axially relative to the fusing belt support roller axis of rotation. The apparatus can include a belt position changing control module (152) coupled to the belt position changing mechanism. The belt position changing control module can be configured to adaptively control a rate of the axial movement of the fusing belt.

20 Claims, 6 Drawing Sheets

APPARATUS AND METHOD FOR CONTROLLING THE AXIAL RATE OF MOVEMENT OF A FUSING BELT IN A PRINTING APPARATUS

RELATED APPLICATIONS

This application is related to the application entitled "Apparatus and Method for Controlling the Change of Direction of a Fusing Belt in a Printing Apparatus," U.S. application Ser. No. 12/693,092, which is filed on the same date as the present application, is commonly assigned to the assignee of the present application, and which is incorporated herein by reference in its entirety.

BACKGROUND

Disclosed herein is an apparatus and method that controls the rate of movement of a fusing belt in a printing apparatus.

Presently, image output devices, such as printers, multifunction media devices, xerographic machines, ink jet printers, and other devices produce images on media sheets, such as paper, substrates, transparencies, plastic, cardboard, or other media sheets. To produce an image, marking material, such as toner, ink jet ink, or other marking material, is applied to a media sheet to create a latent image on the media sheet. A fuser assembly then affixes or fuses the latent image to the media sheet by applying heat and/or pressure to the media sheet.

Fuser assemblies apply pressure using rotational members, such as a fuser belt and a pressure roll, that contact each other at a fuser nip. Pressure is applied to the media sheet with the latent image as the media sheet is fed through the fuser nip to affix the latent image to the media sheet.

Unfortunately, repeated contact between the media sheet edges and the fuser belt results in worn areas, also known as edge wear, on the fuser belt. The worn areas eventually manifest as differential gloss bands on resulting prints, especially after fusing many sheets of one sheet width followed by fusing sheets of a larger sheet width. For example, a differential gloss band appears on 14" wide media sheets after running a large number of 11" wide media sheets. Fuser run cost is a large part of the overall printer marking engine run cost, and edge wear is a leading cause of fusing failure regardless of print engine type, such as mono or color, or market segment, such as office or production. The edge wear occurs in both inboard and outboard areas on fusing members, where the level of wear in either area can dictate edge wear life.

A registration distribution system can automatically move an entire fusing system back and forth in order to spread the edge wear over a larger area on the fuser member surface, which delays the perception of edge wear on resulting prints. Unfortunately, the movement of the fusing system requires a longer lamp to heat a fuser roll and also causes fuser temperature sensors to move with respect to the media sheets. These two issues negatively impact fuser axial temperature uniformity as well as ultimate print gloss axial uniformity.

Thus, there is a need for an apparatus and method that controls the rate of movement of a fusing belt in a printing apparatus that can overcome the above issues as well as provide other benefits in the printing apparatus.

SUMMARY

An apparatus and method that controls the rate of movement of a fusing belt in a printing apparatus is disclosed. The apparatus can include a fusing belt and at least one fusing belt support roller, where the fusing belt can be entrained on the fusing belt support roller. The fusing belt support roller can have an axis of rotation. The apparatus can include a pressure roller that contacts the fusing belt to form a fusing nip. The pressure roller and the fusing belt can be configured to fuse an image on a media sheet in the fusing nip. The apparatus can include a belt position changing mechanism coupled to the fusing belt. The belt position changing mechanism can be configured to move the fusing belt axially relative to the fusing belt support roller axis of rotation. The apparatus can include a belt position changing control module coupled to the belt position changing mechanism. The belt position changing control module can be configured to adaptively control a rate of the axial movement of the fusing belt.

BRIEF DESCRIPTION OF THE DRAWINGS

In order to describe the manner in which advantages and features of the disclosure can be obtained, a more particular description of the disclosure briefly described above will be rendered by reference to specific embodiments thereof, which are illustrated in the appended drawings. Understanding that these drawings depict only typical embodiments of the disclosure and are not therefore to be considered to be limiting of its scope, the disclosure will be described and explained with additional specificity and detail through the use of the accompanying drawings in which.

DETAILED DESCRIPTION

Figure 1:
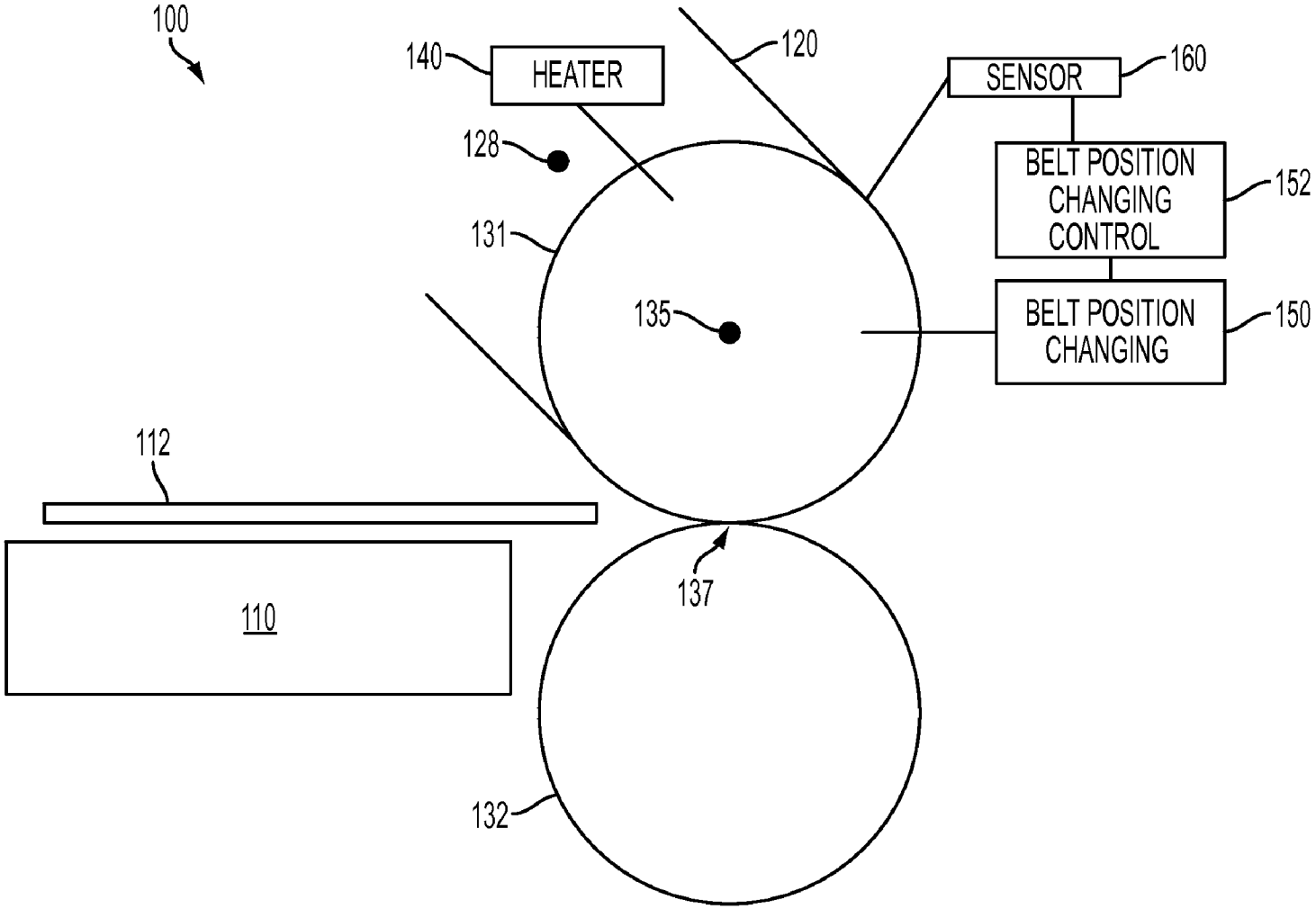
FIG. 1 is an exemplary illustration of an apparatus according to one embodiment.

The embodiments include an apparatus that controls the rate of movement of a fusing belt in a printing apparatus. The apparatus can include a fusing belt and at least one fusing belt support roller, where the fusing belt can be entrained on the fusing belt support roller. The fusing belt support roller can have an axis of rotation. The apparatus can include a pressure roller that contacts the fusing belt to form a fusing nip. The pressure roller and the fusing belt can be configured to fuse an image on a media sheet in the fusing nip. The apparatus can include a belt position changing mechanism coupled to the fusing belt. The belt position changing mechanism can be configured to move the fusing belt axially relative to the fusing belt support roller axis of rotation. The apparatus can include a belt position changing control module coupled to the belt position changing mechanism. The belt position changing control module can be configured to adaptively control a rate of the axial movement of the fusing belt.

The embodiments further include a method that controls the rate of movement of a fusing belt in a printing apparatus having a fusing belt, at least one fusing belt support roller, where the fusing belt can be entrained on the fusing belt support roller, a pressure roller that contacts the fusing belt to form a fusing nip, where the fusing belt support roller can include an axis of rotation. The method can include fusing an image on a media sheet in the fusing nip using the pressure roller and the fusing belt. The method can include moving the fusing belt axially relative to the fusing belt support roller axis of rotation and adaptively controlling a rate of the axial movement of the fusing belt.

The embodiments further include an apparatus that controls the rate of movement of a fusing belt in a printing apparatus. The apparatus can include a media sheet transport configured to transport a media sheet. The apparatus can include a fusing belt. The apparatus can include at least one fusing belt support roller, where the fusing belt can be entrained on the fusing belt support roller, and where the fusing belt support roller can have an axis of rotation. The apparatus can include a heater configured to heat at least a portion of the fusing belt. The apparatus can include a pressure roller that contacts the fusing belt to form a fusing nip, where the pressure roller, the heater, and the fusing belt can be configured to fuse an image on the media sheet in the fusing nip. The apparatus can include a belt position changing mechanism coupled to the fusing belt, where the belt position changing mechanism can be configured to move the fusing belt axially relative to the fusing belt support roller axis of rotation. The apparatus can include a sensor configured to sense an axial position of the fusing belt. The apparatus can include a belt position changing control module coupled to the belt position changing mechanism, where the belt position changing control module can be configured to adaptively control a rate of the axial movement of the fusing belt based on the sensed axial position of the fusing belt.

FIG. 1 is an exemplary illustration of an apparatus 100. The apparatus 100 may be a printer, a multifunction media device, a xerographic machine, a laser printer, a solid or liquid ink printer, or any other device that produces an image on media. The apparatus 100 can include a fusing belt 120. The fusing belt 120 can have an axis of rotation 128. The apparatus 100 can include at least one fusing belt support roller 131, where the fusing belt 120 is entrained on the fusing belt support roller 131. The at least one fusing belt support roller 131 can include or can be a steering roller. The at least one fusing belt support roller 131 can have an axis of rotation 135. The support roller axis of rotation 135 and/or the fusing belt axis of rotation 128 may be at any location depending on the length and configuration of the fusing belt 120. The fusing belt axis of rotation 128 and support roller axis of rotation 135 are used herein as perpendicular to the rotation of the fusing belt 120 to provide a coordinate system for movement of the fusing belt 120 relative to the axis of rotation 128. Accordingly, unless otherwise specified, both the fusing belt axis of rotation 128 and support roller axis of rotation 135 can be used interchangeably to indicate a sidewise movement of the fusing belt 120 with respect to its rotation direction.

The apparatus 100 can include a heater 140 configured to heat the fusing belt 120. The apparatus 100 can include a pressure roller 132 that contacts the fusing belt 120 to form a fusing nip 137. The pressure roller 132 and the fusing belt 120 can be configured to fuse an image on a media sheet 112 as it passes through the fusing nip 137. The heater 140 may also be used to fuse the image on the media sheet 112 as it passes through the fusing nip 137. A steering roller may be the support roller 131 located at the fusing nip 137 or may be separate from a roller located at the fusing nip 137.

The apparatus 100 can include a belt position changing mechanism 150 configured to move the fusing belt 120 axially relative to the at least one fusing belt support roller axis of rotation 135 and/or the fusing belt axis of rotation 128. The belt position changing mechanism 150 can include a software control aspect as well has hardware aspects, such as motors or other actuators (not shown). Furthermore, any mechanism or module described herein can be coupled to a controller, can reside within a controller, can reside within memory, can be autonomous modules or mechanisms, can include software, can include hardware, or can be in any other format useful for a module or mechanism in an image generation device.

The apparatus 100 can include a belt position changing control module 152 coupled to the belt position changing mechanism 150. The belt position changing control module 152 can be an autonomous module, can be included in another controller in the apparatus 100, can be hardware, can be software, or can be any other module useful for controlling the fusing belt position and operation. The belt position changing control module 152 can adaptively control a rate of the axial movement of the fusing belt 120. For example, the belt position changing control module 152 can adaptively control a rate of the axial movement of the fusing belt 120 to change the rate of axial movement of the fusing belt 120 to adapt the rate to a desired rate of axial movement. As a further example, the belt position changing control module 152 can adaptively control an angle of a steering roller relative to the fusing belt axis of rotation 128 to adaptively control the rate of the axial movement of the fusing belt 120.

The apparatus 100 can include a sensor 160 that can sense the rate of the axial movement of the fusing belt 120. The belt position changing control module 152 can adaptively control the rate of the axial movement of the fusing belt 120 based on the sensed rate of the axial movement of the fusing belt 120. For example, the sensor 160 can sense an axial position of the fusing belt 120 and the belt position changing control module 152 can determine a time it takes the fusing belt 120 to travel a known distance based on the sensed axial position of the fusing belt. The belt position changing control module 152 can then adaptively control a rate of the axial movement of the fusing belt 120 by adjusting a steering roller based on the time it takes the fusing belt 120 to travel a known distance.

The sensor 160 can be a multiple position switch coupled to an edge of the fusing belt 120. The multiple position switch can sense the axial position of the fusing belt 120 based on a position of the multiple position switch. The sensor 160 can also be an optical sensor, an analog sensor, a digital sensor, or any other sensor. The belt position changing control module 152 can determine the fusing belt 120 is heading off track based on the sensed axial position of the fusing belt 120. The belt position changing control module 152 can also control the belt position changing mechanism 150 to reverse a direction of movement of the fusing belt 120 based on the sensed axial position of the fusing belt 120.

The sensor 160 can sense when the fusing belt 120 has reached a first axial position and the sensor 160 can sense when the fusing belt has reached a second axial position. The belt changing position changing control module 152 can control the belt position changing mechanism 150 to direct the fusing belt 120 towards the second axial position based on the sensor 160 sensing when the fusing belt has reached the first axial position. The belt changing position changing control module 152 can also control the belt position changing mechanism 150 to direct the fusing belt 120 towards the first axial position based on the sensor 160 sensing when the fusing belt 120 has reached the second axial position.

The belt position changing control module 152 can adaptively control an angle of the steering roller relative to the fusing belt axis of rotation 128 based on the angle of the steering roller 131 relative to the fusing belt axis of rotation 128 based on the sensed axial position of the fusing belt 120 to adaptively control the rate of the axial movement of the fusing belt 120. The belt position changing control module 152 can adaptively control a rate of the axial movement of the fusing belt 120 in a first direction and adaptively control a rate of the axial movement of the fusing belt 120 in a second direction opposite from the first direction, where the belt position changing control module 152 independently adaptively controls the rate of axial movement of the fusing belt 120 in the first direction from adaptively controlling the rate of axial movement of the fusing belt 120 in the second direction. For example, a rate of movement of the fusing belt 120 can be determined based on the sensed axial position of the fusing belt 120 and the belt position changing control module 152 can adaptively control an angle of the steering roller 131 relative to the fusing belt axis of rotation 128 based on the angle of the steering roller 131 relative to the fusing belt axis of rotation 128 and based on the rate of movement of the fusing belt 120. The belt position changing control module 152 can adaptively control a rate of the axial movement of the fusing belt 120 to mitigate edge wear on the fusing belt 120 from media sheets 112 in the fusing nip 137.

According to a related embodiment, the apparatus can include a media transport 110 configured to transport a media sheet 112. The apparatus 100 can include a fusing belt 120 configured to rotate about an axis of rotation 128. The apparatus 100 can include at least one fusing belt support roller 131, where the fusing belt 120 is entrained on the fusing belt support roller 131. The fusing belt support roller 131 can have a support roller axis of rotation 135. The apparatus 100 can include a heater 140 configured to heat the fusing belt 120. The apparatus 100 can include a pressure roller 132 coupled to the fusing belt 120 at a fusing nip 137. The pressure roller 132, the heater 140, and the fusing belt 120 can be configured to fuse an image on a media sheet 112 in the fusing nip 137. The heater 140 may also be used to fuse the image on the media sheet 112 as it passes through the fusing nip 137.

The apparatus 100 can include a belt position changing mechanism 150 configured to move the fusing belt axially in a first direction and in a second direction opposite the first direction relative to the fusing belt axis of rotation 128 and/or the support roller axis of rotation 135.

The apparatus 100 can include a sensor 160 configured to sense the axial location of the fusing belt 120. In particular, the sensor 160 can sense the axial location of the fusing belt 120 relative to the fusing belt axis of rotation 128 and/or the support roller axis of rotation 135. The sensor 160 can be a multiple position switch coupled to an edge of the fusing belt 120, where the multiple position switch can be configured to sense the axial position of the fusing belt 120 based on a position of the multiple position switch.

The apparatus 100 can include a belt position changing control module 152 coupled to the belt position changing mechanism 150. The belt position changing control module 152 can be configured to change an axial location of a change in direction from the first direction to the second direction so the fusing belt 120 changes direction from the first direction to the second direction at different axial locations. The belt position changing control module 152 can also change an axial location of a change in direction from the first direction to the second direction by varying a time of the change in direction from the first direction to the second direction. The belt position changing control module 152 can additionally change an axial location of a change in direction from the first direction to the second direction by delaying a time of the change in direction from the first direction to the second direction. The belt position changing control module 152 can further change an axial location of a change in direction from the first direction to the second direction by determining the fusing belt 120 has reached a specific axial location and by delaying the change in direction from a time when the fusing belt has reached the specific axial location. The belt position changing control module 152 can also change an axial location of a change in direction from the first direction to the second direction to reduce edge wear on the fusing belt 120.

If the sensor 160 is used, the belt position changing control module 152 can change an axial location of a change in direction from the first direction to the second direction based on the sensed axial location of the fusing belt 120. The belt position changing control module 152 can also change an axial location of a change in direction from the first direction to the second direction based on the sensed axial location of the fusing belt 120 by determining the fusing belt 120 has reached a specific axial location and by delaying the change in direction from a time when the fusing belt 120 has reached the specific axial location. The belt position changing control module 152 can additionally change an axial location of a change in direction from the first direction to the second direction based on the sensed axial location of the fusing belt 120 by determining the fusing belt 120 has reached a specific axial location and by varying a delay of the change in direction from each time the fusing belt 120 reaches the specific axial location.

According some embodiments, fusing belt steering can be used in order to distribute edge wear on the fusing belt 120. Active fusing belt steering can be used in order to prevent the fusing belt 120 from getting off track and getting damaged. A steering capability can be combined with smart belt position changing control to mitigate edge wear. The sensor 160, such as a contact sensor, and smart control logic can be used to control the fusing belt travel rate and travel distance.

Smart control for the belt position changing control module 152 can use a stepper motor with a home position for the belt position changing mechanism 150, one or more contact sensors, such as the sensor 160, with at least two positions, and a steering roll, such as the roll 131.

The fusing belt 120 has an extended circumference compared to the circumference of roll fusers to provide an extended wear surface. Another benefit about the belt roll fuser, such as in the apparatus 100, in combination with belt steering for edge wear mitigation, can be the fact that the fusing belt 120 can always be moving in contrast with previous approaches were the whole fuser is moved using a lead-screw in which back-lash on their lead-screw makes the fuser stay still before changing direction, which causes a sharp wear on the ends, which can negatively impact image quality even further. Some fusers currently use 34 mm of total fuser movement and the belt roll fuser in the apparatus 100 can use less than that to accomplish the edge wear goal. The fusing belt 120 can be steered in the range of 10 mm to about 20 mm. The belt position changing control module 152 can limit the travel rate of the belt. For example, if the fusing belt 120 is moving too slow axially, it risks not moving at all and actually moving in the wrong direction. In addition, if the fusing belt 120 is moving too fast axially then such can negatively affect both post-fuser paper registration as well as negatively affect media wrinkle. Therefore, the fusing belt axial travel rate can be controlled within a desired range depending on the application.

According to some embodiments, edge wear smoothing can be combined with fusing belt steering in order to distribute edge wear across the fusing belt 120 and reduce edge wear related defects on media sheets. The edge wear profile can be smoothed by changing the position at which the fusing belt 120 changes direction when moving axially. This can be accomplished by using the sensor 160 and by adding a variable delay on when to steer the fusing belt 120 back. The variable delay can incorporate various amplitudes and it can be random, can be of sine-wave form, can be saw-tooth like, or can be any other variable delay that can yield a desired edge-wear profile. The edge wear smoothing strategy can be built on top of the smart steering control disclosed above.

Due to the nature of the steering mechanism, the fusing belt 120 may travel a bit faster when being close to the edges of its axial travel direction than when close to the center. Thus, the fusing belt 120 will spend less time at the ends than the time it stays at the center. That means that the edge wear profile can be smoothed by the own nature of the steering mechanism. Further smoothing can be used to form a smooth edge wear density profile to reduce the transient differential gloss. This further smoothing can be done by adding a variable delay to the steering mechanism that changes the location at which the fusing belt 120 axially changes direction. The edge wear profile can be shaped by changing the amplitude of the variable delay as well as its type. Different types of variable delays that can be used include sine wave, sawtooth, random, and other variable delays. For example, the edge wear profile can be smoothed using a sine wave-type variable delay with a maximum amplitude of 3 seconds. The edge wear profile can also be smoothed using a delay with a maximum amplitude of 10 seconds. These examples have been simulated and produced desirable results. The delay can be used as an input to the belt position changing control module 152 to maintain the fusing belt average travel rate. For example, the delay can be subtracted from the time that took the belt to travel from inboard to outboard or from outboard to inboard. The smart steering technology of the apparatus 100 can be used to smooth edge wear of the fusing belt 120 by using a variable delay in the fusing belt travel.

Figure 2:
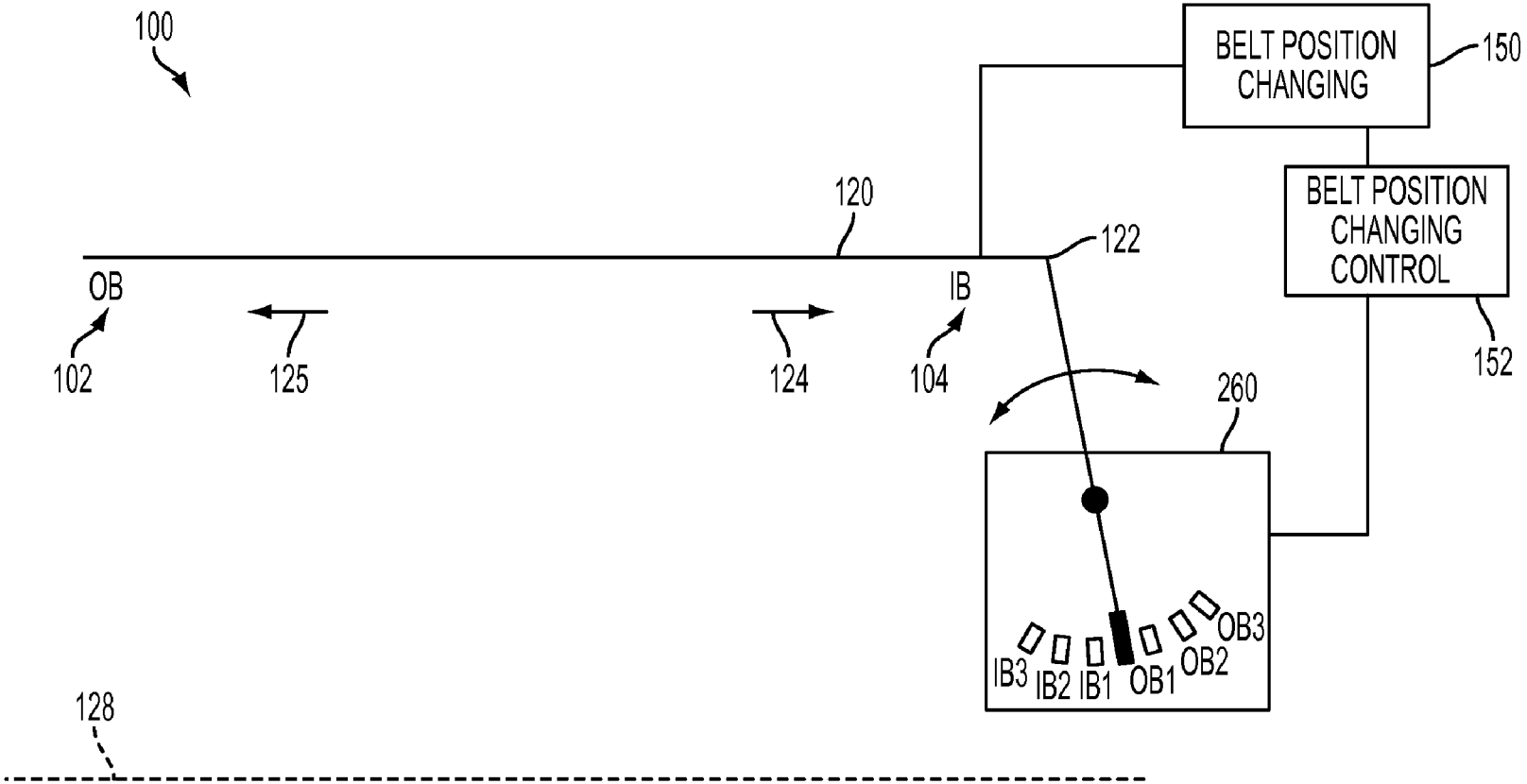
FIG. 2 is an exemplary illustration of an apparatus according to another embodiment.

FIG. 2 is an exemplary illustration of the apparatus 100 according to a related embodiment where some elements may not be shown for illustrative purposes. The apparatus 100 can include the fusing belt 120 having a fusing belt axis of rotation 128 and an edge 122. The fusing belt edge 122 should not be confused with the edge of a media sheet that causes edge wear on the fusing belt 120. The apparatus 100 can include a belt position changing mechanism 150 and a belt position changing control module 152. The apparatus 100 can have first end 104, such as an inboard end, and a second end 102, such as an outboard end. According to this embodiment, the apparatus 100 can include a multiple position switch 260 as the switch. The multiple position switch 260 can be coupled to the edge 122 of the fusing belt 120. The multiple position switch 260 can sense an axial position of the fusing belt 120. Other switches can be used that can provide more or less precise detection of the fusing belt axial position depending on the desired resolution of axial position detection.

The belt position changing mechanism 150 can be configured to move the fusing belt 120 axially in a first direction 124 and in a second direction 125 opposite the first direction 124 relative the fusing belt axis of rotation 128. The belt position changing control module 152 can adaptively control an angle of a steering roller (not shown) relative to the fusing belt axis of rotation 128 to adaptively control the rate of the axial movement 124 and 128 of the fusing belt 120. The belt position changing control module 152 can adaptively control an angle of the steering roller relative to the fusing belt axis of rotation 128 based on the angle of the steering roller relative to the fusing belt axis of rotation 128 and based on the sensed axial position of the fusing belt 120 to adaptively control the rate of the axial movement 124 and 125 of the fusing belt 120. For example, a rate of movement of the fusing belt 120 can be determined based on the sensed axial position of the fusing belt 120 and the belt position changing control module 152 can adaptively control an angle of the steering roller relative to the fusing belt axis of rotation 128 based on the angle of the steering roller relative to the axis of rotation 128 and based on the rate of movement of the fusing belt 120.

For example, when the fusing belt 120 reaches its inboard limit #1 (IB1) the steering roller can rotate to steer the fusing belt 120 towards the outboard end 102. When the fusing belt 120 reaches the outboard limit #1 (OB1) the steering roller can rotate to steer the fusing belt 120 towards the inboard end 104. The steering roller steering angle can be variable and can depend on the belt position changing control module output. The belt position changing control module 152 can first use a preset large steering angle in order to assure that the fusing belt 120 will steer first towards outboard end 102. When the OB1 sensor triggers, the steering roller can steer the fusing belt 120 towards inboard end 104 using a preset large angle. When the IB1 sensor triggers, the steering roller can steer the fusing belt 120 back towards the outboard end 102 using a preset large angle. The next outboard to inboard steering angle can depend on the control algorithm, which can use the previous one or more times it took for the belt to move from OB1 to IB1 as well as the previous one or more outboard to inboard steering angles as inputs. The next inboard to outboard steering angle can depend on the control algorithm, which can use the previous one or more times it took for the belt to move from IB1 to OB1 as well as the previous one or more outboard to inboard steering angles as inputs. Different types of control algorithms can be used by the belt position changing control module 152 to control the steering angle:

$$\text{Angle}[n+1]=\text{Angle}[0]-K*E[n] \qquad \text{Controller\#1}$$

$$\text{Angle}[n+1]=\text{Angle}[n]-K*E[n] \qquad \text{Controller\#2}$$

$$\text{Angle}[n+1]=\text{Angle}[n]+(\text{Angle}[n]-\text{Angle}[n-1])/(\text{Time}[n]-\text{Time}[n-1])*E[n] \qquad \text{Controller\#3}$$

$$\text{Angle}[n+1]=\text{Angle}[n]+(\text{Angle}[n]-\text{Angle}[n-1])/(\text{Time}[n]-\text{Time}[n-1])*E[n], \text{ when Time}[n] \text{ is outside the desired range}$$

$$\text{Angle}[n+1]=\text{Angle}[n]+K*E[n], \text{ if Time}[n] \text{ is within desired range} \qquad \text{Controller\#4}$$

Where the error E[n]=(Desired Travel Time)−Time[n] and where K is the gain, which can be determined based on simulation, based on empirical data, based on an accurate model, or otherwise determined.

The advantage of using controller#2 over controller#1 can be that controller#2 can remember the last steering angle used. Remembering the last steering angle used can reduce the time to reach the desired travel time significantly. Controller#3 can have an advantage of increasing convergence time significantly. Controller#3 can first steer the fusing belt 120 with a preset large angle and the second time with a preset small angle, so that by the third time it steers, it will guess the required steering angle based on the last two iterations. Controller#3 can converge within 3 to 4 iterations compared to 10 to 20 iterations when using controller#2. Controller#3 may not compensate for drifts in the travel in belt travel time when the drift is smaller than a noise level, while controller#2 can.

If a four position switch is used as the multiple position switch 260, then OB2 and IB2 can be used as limit switches to determine when the fusing belt 120 is going of track so the apparatus 100 can shut down or otherwise operate to bring the fusing belt 120 back to its normal position. Another option is when either the OB2 or IB2 sensor is triggered, the fusing belt 120 can steer with the preset large angle and if the sensors are not disabled for a preset small amount of time, such as in the order of seconds, then the control algorithm can shut down. In the case the fusing belt 120 is able to steer back then the control algorithm can get enabled again in order to return the fusing belt travel rate to within the desired range.

If a six position switch is used as the multiple position switch 260, the OB2 and IB2 positions can be exclusively used to steer the belt with the preset large angle. When either the OB3 or IB3 are triggered the apparatus 100 can shut down in order to prevent the fusing belt 120 from getting damaged.

When installing a new fusing belt, there are at least two approaches that the belt position changing control module 152 can take. The first approach is the belt position changing control module 152 can use the last steering angles used by the old belt, and then use either Controller#1, #2, #3 or #4 in order to achieve the desired belt steering rate. However, the new belt may not necessarily behave properly with those steering angles and may go off track. In that case a reactive action like the one explained above when using contact sensors with either four or six positions can be used. The second approach can be to reset the fuser steering control and enter a steering learning mode so that the first steering angle the belt position changing control module 152 uses is a preset large steering angle, and then use either Controller#1, #2, #3 or #4 in order to achieve the desired belt steering rate. Controller#4 can be used for the learning mode for which the first steering angles can be a preset large and small angle. The convergence time of the controller can be optimized by properly setting the large and small angles.

Testing has shown that this control technique is feasible. Controller#2 has proven to remain stable and converge to within the same times as the ones predicted by modeling. Also, controller#4 has proven to converge within three to four iterations to within 10% of the travel time setpoint. The control can be implemented so that it steers first with a large preset angle and then with a preset small angle and can use those two first iterations to predict the required steering angle using a secant method. The secant method can be used until the travel time is within 10% of its travel time setpoint.

Figure 3:
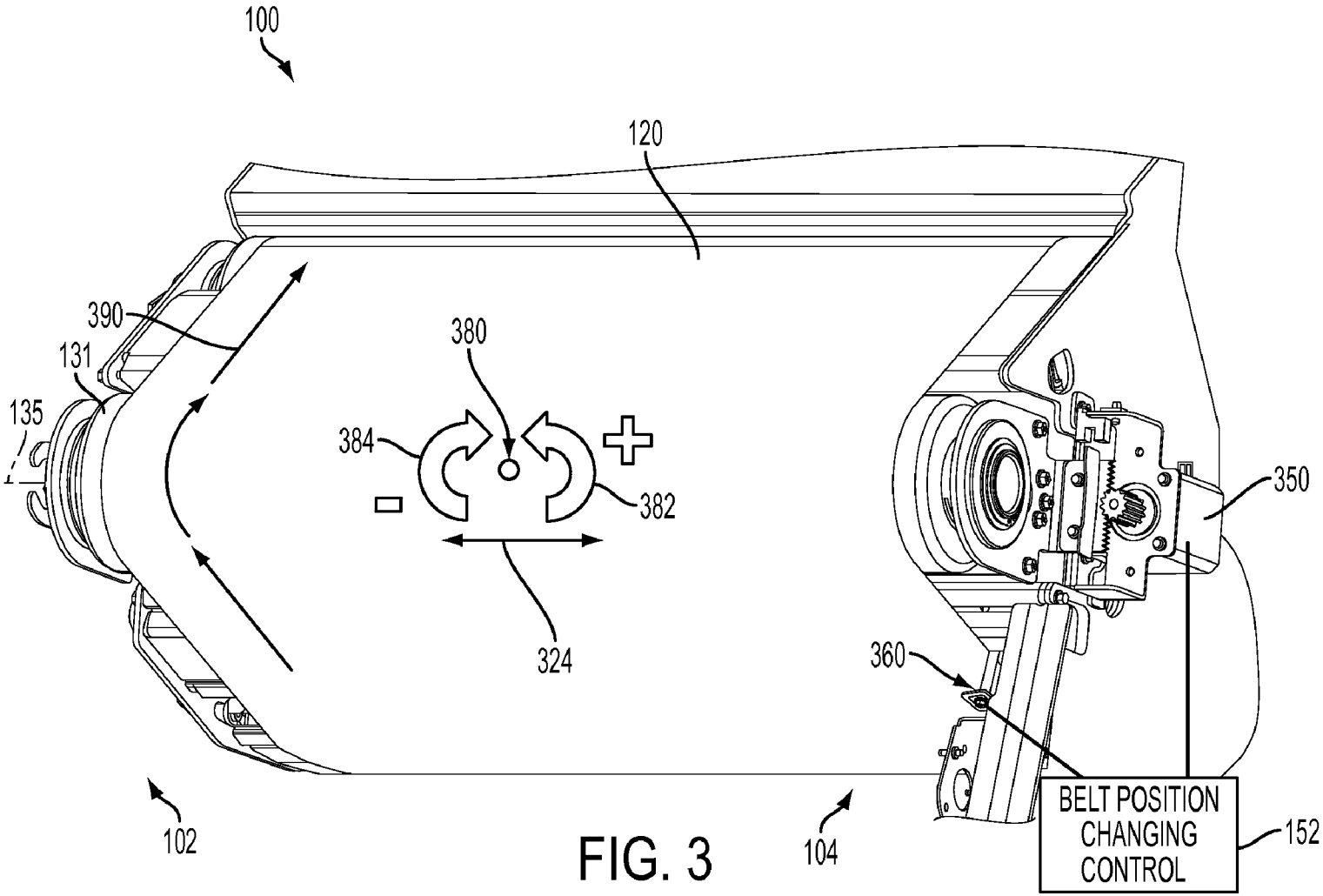
FIG. 3 is an exemplary illustration of an apparatus according to another embodiment.

FIG. 3 is an exemplary illustration of the apparatus 100 according to a related embodiment where some elements may not be shown for illustrative purposes. The apparatus 100 can include the fusing belt 120 that can rotate in a process direction 390. The apparatus 100 can include the steering roller 131 that can have an axis of rotation 135. The apparatus 100 can have first end 104, such as an inboard end, and a second end 102, such as an outboard end. The apparatus 100 can include the belt position changing control module 152. The apparatus 100 can include a stepper motor 350 that can act as a belt position changing mechanism. The apparatus 100 can also include a sensor 360. Like elements can operate in a similar manner as those described in the other figures.

In operation, the belt position changing control module 152 can adaptively control an angle of a steering roller 131 relative to a fusing belt axis of rotation to adaptively control the rate of the axial movement 324 of the fusing belt 120. For example, the belt position changing control module 152 can control the stepper motor 350 to adjust the rotation 382 and 384 about a steering belt center 380. As a further example, when the sensor 360 detects the fusing belt 120 has reached limit at the second end 102, the steering roller 131 can rotate 384 to steer the fusing belt 120 towards the first end 104.

Figure 4:
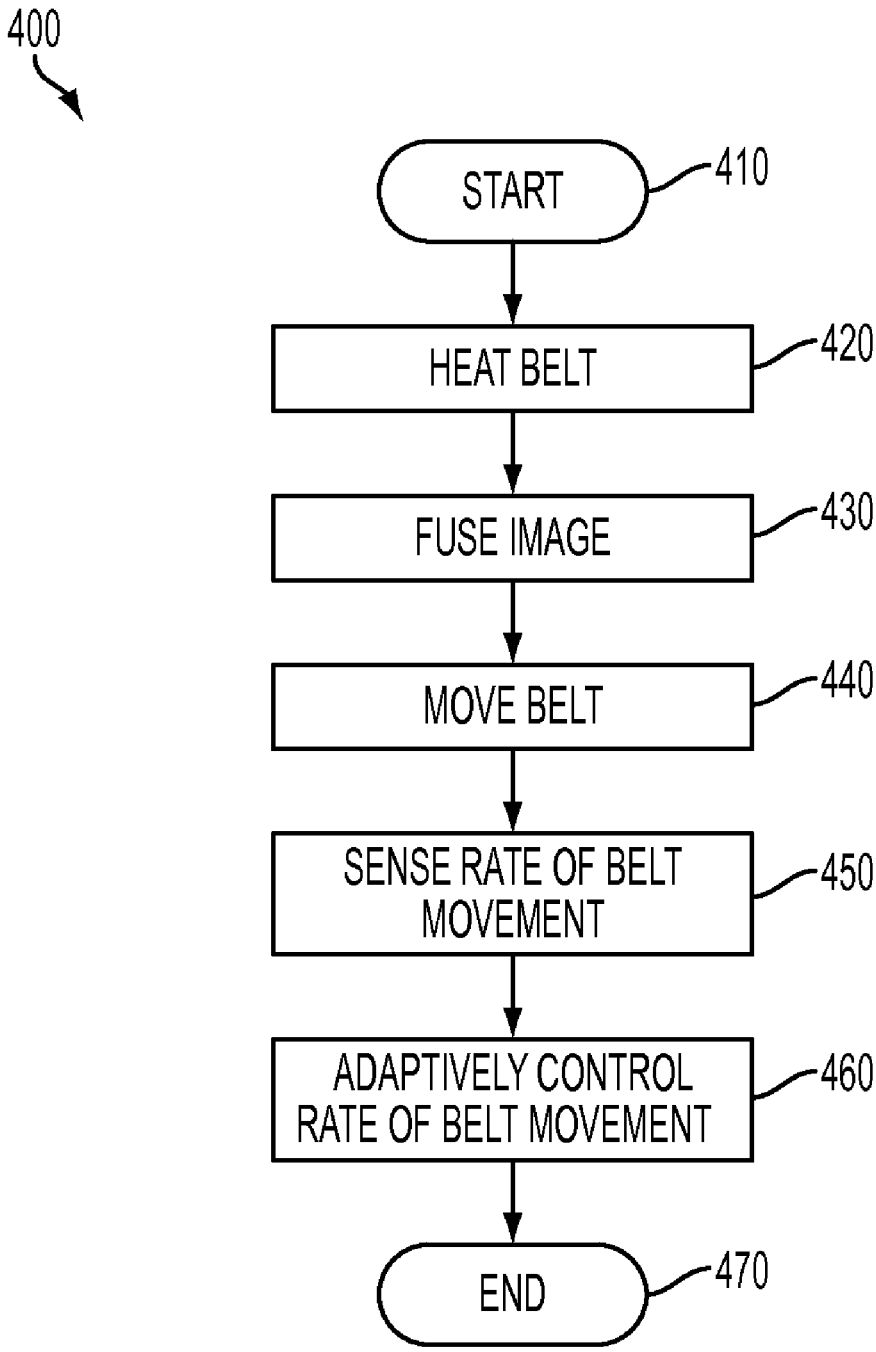
FIG. 4 illustrates an exemplary flowchart of a method of controlling a rate of movement of a fusing belt.

FIG. 4 illustrates an exemplary flowchart 400 of a method of controlling the rate of movement of a fusing belt in a printing apparatus having a fusing belt, at least one fusing belt support roller, where the fusing belt is entrained on the fusing belt support roller, a heater configured to heat at least a portion of the fusing belt, a pressure roller that contacts the fusing belt to form a fusing nip, where the fusing belt support roller can include an axis of rotation. The at least on fusing belt support roller may include or may be a steering roller coupled to the fusing belt.

The method starts at 410. At 420, the fusing belt can be heated using the heater. At 430, an image can be fused on a media sheet in the fusing nip using the pressure roller and the fusing belt. The image can also be fused on a media sheet in the fusing nip using the heater. At 440, the fusing belt can be moved axially relative to the at least one fusing belt support roller axis of rotation.

At 450, the rate of the axial movement of the fusing belt can be sensed. For example, an axial position of the fusing belt can be sensed and the axial position can be used to determine the rate of axial movement of the fusing belt. As a further example, a time it takes the fusing belt to travel a known distance can be determined based on the sensed axial position of the fusing belt. Also, the fact that the fusing belt has reached a first axial position can be sensed.

At 460, a rate of the axial movement of the fusing belt can be adaptively controlled. The rate of the axial movement of the fusing belt can be adaptively controlled by adaptively controlling an angle of the steering roller relative to an axis of rotation. The rate of the axial movement of the fusing belt can be adaptively controlled by adaptively controlling the rate of the axial movement of the fusing belt based on the sensed rate of the axial movement of the fusing belt. The rate of the axial movement of the fusing belt can be adaptively controlled by adaptively controlling a rate of the axial movement of the fusing belt based on the time it takes the fusing belt to travel a known distance. Also, the fusing belt can be directed in an opposite direction towards a second axial position based on sensing the fusing belt has reached the first axial position. The rate of the axial movement of the fusing belt can be adaptively controlled to mitigate edge wear on the fusing belt from media sheets in the fusing nip. At 470, the method can end.

According to some embodiments, all of the steps of the flowchart 400 are not necessary. For example, one embodiment may include moving 440 the fusing belt axially and adaptively controlling 460 a rate of axial movement of the fusing belt, which can be independent from fusing 430 an image. As a further example, adaptively controlling 460 a rate of axial movement of the fusing belt may be performed at a separate time from fusing 430 an image or may be performed while or in between fusing 430 an image. Additionally, the flowchart 400 may be performed numerous times, such as iteratively. For example, the flowchart 400 may loop back to earlier steps from later steps, such as by looping back to moving 440 the fusing belt axially after adaptively controlling 460 a rate of axial movement of the fusing belt. Furthermore, many of the steps are typically performed concurrently or in parallel processes.

Figure 5:
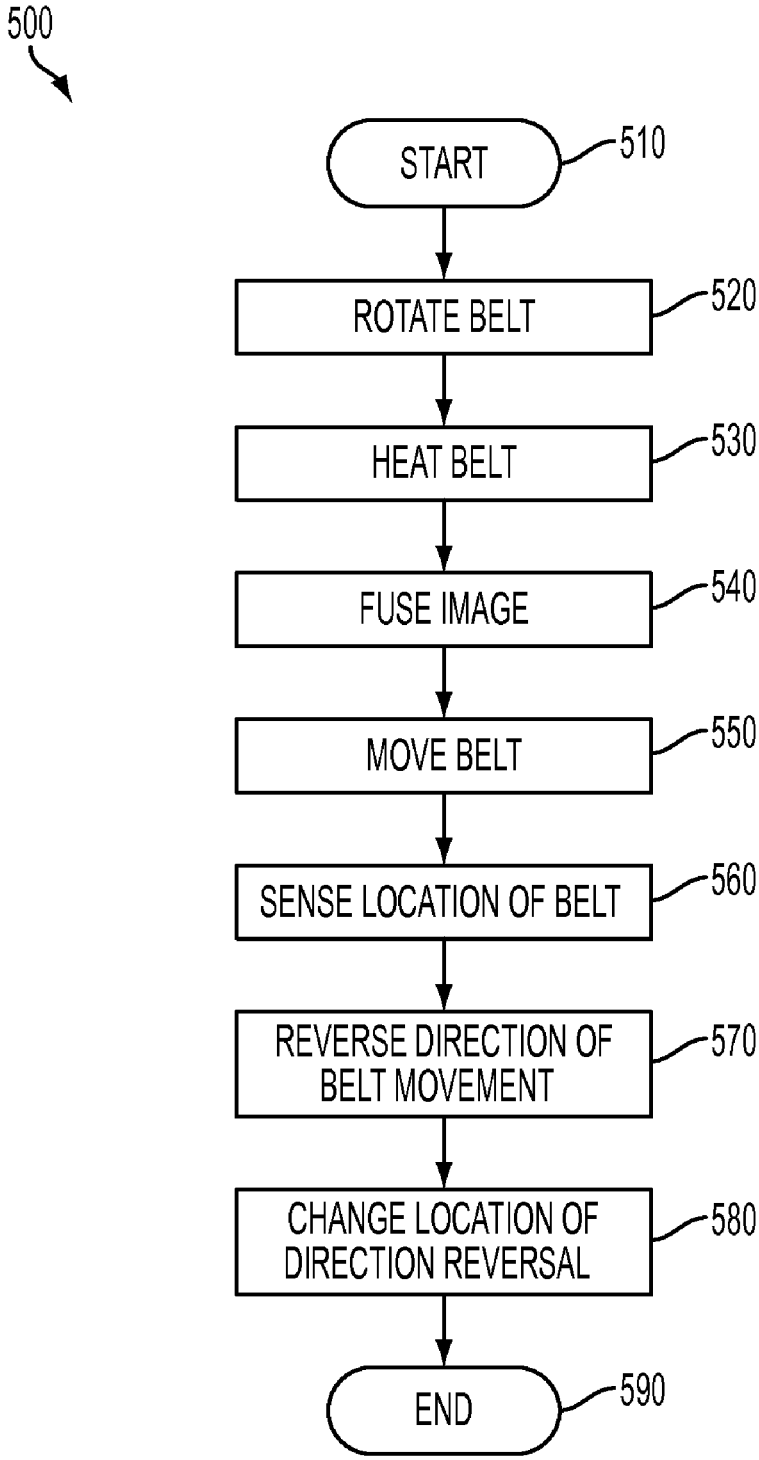
FIG. 5 illustrates an exemplary flowchart of a method of controlling a change of direction of a fusing belt.

FIG. 5 illustrates an exemplary flowchart 500 of a method of controlling a change of direction of a fusing belt in a printing apparatus having a fusing belt, at least one fusing belt support roller, where the fusing belt is entrained on the fusing belt support roller, a heater configured to heat at least a portion of the fusing belt, and a pressure roller in contact with the fusing belt to form a fusing nip. The printing apparatus may also have a sensor. The sensor may be a multiple position switch coupled to an edge of the fusing belt, may be an analog sensor, may be a digital sensor, may be an optical sensor or may be any other sensor that can sense a position of the fusing belt.

The method starts at 510. At 520, the fusing belt can be rotated about an axis of rotation. At 530, the fusing belt can be heated using the heater. At 540, an image can be fused on a media sheet in the fusing nip using the pressure roller and the fusing belt. The image can also be fused on a media sheet in the fusing nip using the heater. At 550, the fusing belt can be moved axially in a first direction relative to the axis of rotation. At 560, an axial location of the fusing belt can be sensed using the sensor. The axial location of the fusing belt can be sensed based on a position of a multiple position switch. At 570, a direction of the fusing belt can be reversed at an axial location to move the fusing belt in a second direction opposite the first direction.

At 580, the axial location of the reversal of direction from the first direction to the second direction can be changed so the fusing belt changes direction from the first direction to the second direction at different axial locations. The axial location of the reversal of direction can be changed by varying a time of the change in direction from the first direction to the second direction. The axial location of the reversal of direction can be changed by delaying a time of the change in direction from the first direction to the second direction. The axial location of the reversal of direction can be changed by determining the fusing belt has reached a specific axial location and by delaying the change in direction from a time when the fusing belt has reached the specific axial location. The axial location of the reversal of direction can be changed to reduce edge wear on the fusing belt.

If the axial location of the fusing belt is sensed, the axial location of the reversal of direction can be changed based on the sensed axial location of the fusing belt. The axial location of the reversal of direction can be changed based on the sensed axial location of the fusing belt by delaying the reversal of direction from a time when the fusing belt has reached the sensed axial location. The axial location of the reversal of direction can be changed by varying a delay of the reversal of direction from each time the fusing belt reaches the sensed axial location. At 580, the method can end.

According to some embodiments, all of the steps of the flowchart 500 are not necessary. For example, one embodiment may include moving 550 the fusing belt axially and changing 580 a location of a reversal of direction of the fusing belt, which can be independent from fusing 540 the image. As a further example, changing 580 a location of a reversal of direction of the fusing belt may be performed at a separate time from fusing 540 the image or may be performed while or in between fusing 540 an image. Additionally, the flowchart 500 may be performed numerous times, such as iteratively. For example, the flowchart 500 may loop back to earlier steps from later steps, such as by looping back to moving 550 the fusing belt axially after changing 580 a location of a reversal of direction of the fusing belt. Furthermore, many of the steps are typically performed concurrently or in parallel processes.

Figure 6:
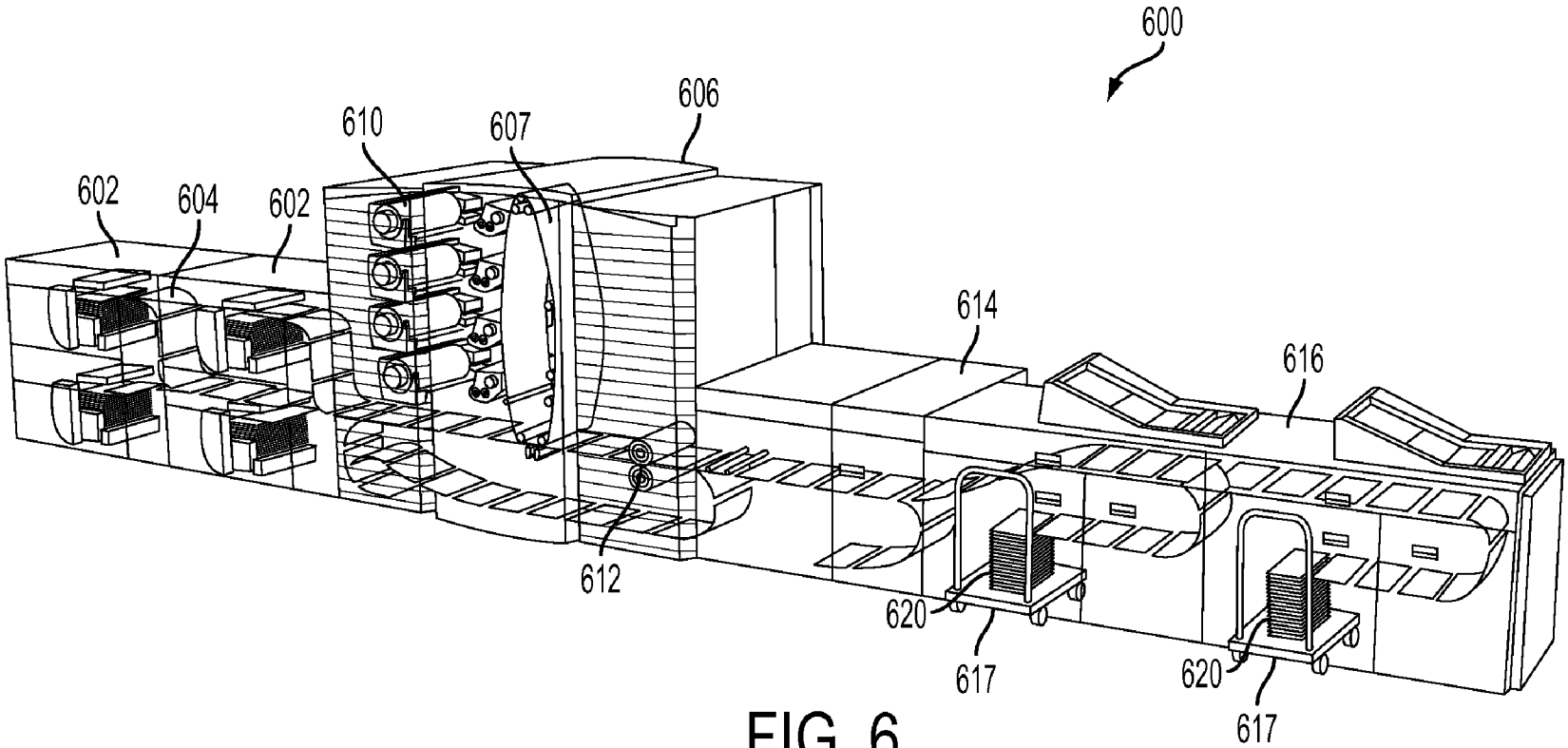
FIG. 6 is an exemplary illustration of a printing apparatus according to one embodiment.

FIG. 6 illustrates an exemplary printing apparatus 600 that can incorporate the apparatus 100. As used herein, the term "printing apparatus" encompasses any apparatus, such as a digital copier, bookmaking machine, multifunction machine, and other printing devices that perform a print outputting function for any purpose. The printing apparatus 600 can be used to produce prints from various media, such as coated, uncoated, previously marked, or plain paper sheets. The media can have various sizes and weights. In some embodiments, the printing apparatus 600 can have a modular construction. As shown, the printing apparatus 600 can include at least one media feeder module 602, a printer module 606 adjacent the media feeder module 602, an inverter module 614 adjacent the printer module 606, and at least one stacker module 616 adjacent the inverter module 614.

In the printing apparatus 600, the media feeder module 602 can be adapted to feed media 604 having various sizes, widths, lengths, and weights to the printer module 606. In the printer module 606, toner is transferred from an arrangement of developer stations 610 to a charged photoreceptor belt 607 to form toner images on the photoreceptor belt 607. The toner images are transferred to the media 604 fed through a paper path. The media 604 are advanced through a fuser 612 adapted to fuse the toner images on the media 604. The fuser 612 can include the apparatus 100. The inverter module 614 manipulates the media 604 exiting the printer module 606 by either passing the media 604 through to the stacker module 616, or by inverting and returning the media 604 to the printer module 606. In the stacker module 616, printed media are loaded onto stacker carts 617 to form stacks 620.

Although the above description is directed toward a fuser used in xerographic printing, it will be understood that the teachings and claims herein can be applied to any treatment of marking material on a medium. For example, the marking material may comprise liquid or gel ink, and/or heat- or radiation-curable ink; and/or the medium itself may have certain requirements, such as temperature, for successful printing. The heat, pressure and other conditions required for treatment of the ink on the medium in a given embodiment may be different from those suitable for xerographic fusing.

According to some embodiments, a smart controlled movement of a fusing belt relative to the media can be used as a belt roll fuser strategy to mitigate edge wear. Process speed and steering roll angle can control the rate of axial belt movement. If the process speed is fixed, the steering roll angle can be used to manage belt walk. The greater the angle, the faster the belt will track. The time the fusing belt takes to travel a known distance, such as by using a multi position contact switch, can establish and change walk rate. Learning routines can be used to empirically measure the belt walk rate and adjust the steering roll angle to achieve desired travel time. Too great of an angle where the fusing belt walks fast can cause media to shift in the fusing nip, which can result in wrinkles and/or mis-registration. Too small of an angle where the belt walks slowly can result in the belt moving in the wrong direction and/or less edge wear control. In addition, the sensor can include out-of-bounds positions for both inboard and outboard. Once walk rate and distance are under control any number of additional edge-smoothing algorithms may be employed.

Embodiments may be implemented on a programmed processor. However, the embodiments may also be implemented on a general purpose or special purpose computer, a programmed microprocessor or microcontroller and peripheral integrated circuit elements, an integrated circuit, a hardware electronic or logic circuit such as a discrete element circuit, a programmable logic device, or the like. In general, any device on which resides a finite state machine capable of implementing the embodiments may be used to implement the processor functions of this disclosure.

While this disclosure has been described with specific embodiments thereof, it is evident that many alternatives, modifications, and variations will be apparent to those skilled in the art. For example, various components of the embodiments may be interchanged, added, or substituted in the other embodiments. Also, all of the elements of each figure are not necessary for operation of the embodiments. For example, one of ordinary skill in the art of the embodiments would be enabled to make and use the teachings of the disclosure by simply employing the elements of the independent claims. Accordingly, the embodiments of the disclosure as set forth herein are intended to be illustrative, not limiting. Various changes may be made without departing from the spirit and scope of the disclosure.

In this document, relational terms such as "first," "second," and the like may be used solely to distinguish one entity or action from another entity or action without necessarily requiring or implying any actual such relationship or order between such entities or actions. Also, relational terms, such as "top," "bottom," "front," "back," "horizontal," "vertical," and the like may be used solely to distinguish a spatial orientation of elements relative to each other and without necessarily implying a spatial orientation relative to any other physical coordinate system. The term "coupled," unless otherwise modified, implies that elements may be connected together, but does not require a direct connection. For example, elements may be connected through one or more intervening elements. Furthermore, two elements may be coupled by using physical connections between the elements, by using electrical signals between the elements, by using radio frequency signals between the elements, by using optical signals between the elements, by providing functional interaction between the elements, or by otherwise relating two elements together. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a," "an," or the like does not, without more constraints, preclude the existence of additional identical elements in the process, method, article, or apparatus that comprises the element. Also, the term "another" is defined as at least a second or more. The terms "including," "having," and the like, as used herein, are defined as "comprising."

We claim:

1. An apparatus comprising:

a fusing belt;

at least one fusing belt support roller, where the fusing belt is entrained on the fusing belt support roller, the at least one fusing belt support roller having an axis of rotation;

a pressure roller that contacts the fusing belt to form a fusing nip, where the pressure roller and the fusing belt are configured to fuse an image on a media sheet in the fusing nip;

a belt position changing mechanism coupled to the fusing belt, the belt position changing mechanism configured to move the fusing belt axially relative to the at least one fusing belt support roller axis of rotation; and a belt position changing control module coupled to the belt position changing mechanism, the belt position changing control module configured to axially move the fusing belt periodically and regularly back and forth in a first direction and a second direction along the axis of rotation according to a control algorithm, where the first direction is opposite from the second direction, and configured to adaptively control a rate of the axial movement of the fusing belt using previous one or more times it took for the fusing belt to move back and forth as inputs for the control algorithm.

2. The apparatus according to claim 1, wherein the at least one fusing belt support roller includes a steering roller, where the fusing belt is entrained on the steering roller and wherein the belt position changing control module is configured to adaptively control an angle of the steering roller relative to an axis of rotation to adaptively control the rate of the axial movement of the fusing belt in a first direction and adaptively control a rate of the axial movement of the fusing belt in a second direction opposite from the first direction, where the belt position changing control module adaptively controls the rate of axial movement of the fusing belt in the first direction independently from adaptively controlling the rate of axial movement of the fusing belt in the second direction.

3. The apparatus according to claim 1, further comprising a sensor configured to sense the rate of the axial movement of the fusing belt, wherein the belt position changing control module is configured to adaptively control a rate of the axial movement of the fusing belt based on the sensed rate of the axial movement of the fusing belt.

4. The apparatus according to claim 1, further comprising a sensor configured to sense an axial position of the fusing belt.

5. The apparatus according to claim 4, wherein the belt position changing control module is configured to determine a time it takes the fusing belt to travel a known distance based on the sensed axial position of the fusing belt, and wherein the belt position changing control module is configured to adaptively control a rate of the axial movement of the fusing belt based on the time it takes the fusing belt to travel a known distance.

6. The apparatus according to claim 5, wherein the sensor comprises a multiple position switch coupled to an edge of the fusing belt wherein the multiple position switch is configured to sense the axial position of the fusing belt based on a position of the multiple position switch.

7. The apparatus according to claim 4, wherein the belt position changing control module is configured to determine the fusing belt is heading off track based on the sensed axial position of the fusing belt.

8. The apparatus according to claim 4, wherein the belt position changing control module is configured to control the belt position changing mechanism to reverse a direction of movement of the fusing belt based on the sensed axial position of the fusing belt.

9. The apparatus according to claim 4, wherein the sensor is configured to sense when the fusing belt has reached a first axial position and the sensor is configured to sense when the fusing belt has reached a second axial position, wherein the belt changing position changing control module is configured to control the belt position changing mechanism to direct the fusing belt towards the second axial position based on the sensor sensing when the fusing belt has reached the first axial position, and wherein the belt changing position changing control module is configured to control the belt position changing mechanism to direct the fusing belt towards the first axial position based on the sensor sensing when the fusing belt has reached the second axial position.

10. The apparatus according to claim 1, wherein the at least one fusing belt support roller includes a steering roller, where the fusing belt is entrained on the steering roller, and wherein the belt position changing control module is configured to adaptively control an angle of the steering roller relative to an axis of rotation based on the angle of the steering roller relative to the axis of rotation of the fusing belt and based on the sensed axial position of the fusing belt to adaptively control the rate of the axial movement of the fusing belt.

11. The apparatus according to claim 1, wherein the belt position changing control module is configured to adaptively control a rate of the axial movement of the fusing belt according to the control algorithm that mitigates edge wear on the fusing belt from media sheets in the fusing nip, where the edge wear is caused by repeated contact between edges of the media sheet edges and the fusing belt.

12. A method in an apparatus including a fusing belt, at least one fusing belt support roller, where the fusing belt is entrained on the fusing belt support roller, a pressure roller that contacts the fusing belt to form a fusing nip, where the fusing belt support roller includes an axis of rotation, the method comprising:

fusing an image on a media sheet in the fusing nip using the pressure roller and the fusing belt;

moving the fusing belt axially relative to the at least one fusing belt support roller axis of rotation; and adaptively controlling a rate of the axial movement of the fusing belt using previous one or more times it took for the fusing belt to move back and forth as inputs for control while periodically and regularly axially moving the fusing belt back and forth in a first direction and a second direction along the axis of rotation to mitigate edge wear on the fusing belt, where the first direction is opposite from the second direction and where the edge wear is caused by repeated contact between the media sheet edges and the fusing belt.

13. The method according to claim 12, wherein the at least on fusing belt support roller includes a steering roller, where the fusing belt is entrained on the steering roller, and wherein adaptively controlling the rate of the axial movement of the fusing belt includes adaptively controlling an angle of the steering roller relative to an axis of rotation.

14. The method according to claim 12, further comprising sensing the rate of the axial movement of the fusing belt, wherein adaptively controlling the rate of the axial movement of the fusing belt comprises adaptively control the rate of the axial movement of the fusing belt based on the sensed rate of the axial movement of the fusing belt.

15. The method according to claim 12, further comprising sensing an axial position of the fusing belt.

16. The method according to claim 15, further comprising determining a time it takes the fusing belt to travel a known distance based on the sensed axial position of the fusing belt, wherein adaptively controlling a rate of the axial movement of the fusing belt comprises adaptively controlling a rate of the axial movement of the fusing belt based on the time it takes the fusing belt to travel a known distance.

17. The method according to claim 15, further comprising:

sensing the fusing belt has reached a first axial position; and directing the fusing belt in an opposite direction towards a second axial position based on sensing the fusing belt has reached the first axial position.

18. The method according to claim 12, wherein adaptively controlling a rate of the axial movement of the fusing belt comprises adaptively controlling a rate of the axial movement of the fusing belt to mitigate edge wear on the fusing belt from media sheets in the fusing nip.

19. An apparatus comprising:

a media sheet transport configured to transport a media sheet;

a fusing belt;

at least one fusing belt support roller, where the fusing belt is entrained on the fusing belt support roller, the fusing belt support roller having an axis of rotation;

a heater configured to heat at least a portion of the fusing belt;

a pressure roller that contacts the fusing belt to form a fusing nip, where the pressure roller, the heater, and the fusing belt are configured to fuse an image on the media sheet in the fusing nip;

a belt position changing mechanism coupled to the fusing belt, the belt position changing mechanism configured to move the fusing belt axially relative to the at least one fusing belt support roller axis of rotation;

a sensor configured to sense an axial position of the fusing belt along the axis of rotation; and a belt position changing control module coupled to the belt position changing mechanism, the belt position changing control module configured to adaptively control a rate of the axial movement of the fusing belt back and forth in a first direction and a second direction along the axis of rotation based on the sensed axial position of the fusing belt using previous one or more times it took for the fusing belt to move back and forth as inputs for control, where the first direction is opposite from the second direction and where the axial movement of the fusing belt back and forth in the first direction and the second direction is periodic and regular.

20. The apparatus according to claim 19, wherein the at least one fusing belt support roller includes a steering roller, where the fusing belt is entrained on the steering roller, and wherein the belt position changing control module is configured to adaptively control an angle of the steering roller relative to an axis of rotation based on the angle of the steering roller relative to the axis of rotation of the fusing belt and based on the sensed axial position of the fusing belt to adaptively control the rate of the axial movement of the fusing belt and configured to adaptively control the rate of the axial movement of the fusing belt back and forth in the first direction and the second direction to mitigate edge wear on the fusing belt, where the edge wear is caused by repeated contact between media sheet edges and the fusing belt.

* * * * *